US006572319B1

(12) United States Patent
Simmons, III et al.

(10) Patent No.: US 6,572,319 B1
(45) Date of Patent: Jun. 3, 2003

(54) MODULAR CELL ELEVATOR FOR CONTAINERSHIP

(75) Inventors: George R. Simmons, III, Haddon Heights, NJ (US); Edmond J. Dougherty, Wayne, PA (US); Gregory M. Katucki, North Wales, PA (US)

(73) Assignee: August Design, Ardmore, PA (US)

( * ) Notice: Subject to any disclaimer, the term of this patent is extended or adjusted under 35 U.S.C. 154(b) by 85 days.

(21) Appl. No.: 09/666,422

(22) Filed: Sep. 20, 2000

Related U.S. Application Data

(60) Provisional application No. 60/154,775, filed on Sep. 20, 1999.

(51) Int. Cl.[7] ..... B63B 27/00
(52) U.S. Cl. ..... 414/143.2; 414/142.8
(58) Field of Search ..... 414/141.7, 142.8, 414/143.2

(56) References Cited

U.S. PATENT DOCUMENTS

| | | | | |
|---|---|---|---|---|
| 2,247,146 A | * | 6/1941 | Baldwin | 414/142.8 X |
| 2,938,638 A | * | 5/1960 | Kersh | 414/143.2 |
| 2,963,310 A | | 12/1960 | Abolins | |
| 3,414,145 A | * | 12/1968 | Calabrese | 414/143.2 |
| 3,494,486 A | * | 2/1970 | Knight, Jr. et al. | 414/143.2 |
| 3,578,374 A | | 5/1971 | Glassmeyer | |
| 3,598,256 A | | 8/1971 | Kinkopf | |
| 3,636,905 A | * | 1/1972 | Wilson et al. | 414/142.8 X |
| 3,726,426 A | | 4/1973 | Tingskog | |
| 4,068,878 A | * | 1/1978 | Wilner | 294/81.53 X |
| 4,106,639 A | | 8/1978 | Montgomery et al. | |
| 4,158,416 A | | 6/1979 | Podesta | |
| 4,172,685 A | | 10/1979 | Nabeshima et al. | |
| 4,610,594 A | | 9/1986 | Lane | |
| 4,666,356 A | * | 5/1987 | Newbury | 414/143.2 X |
| 5,775,866 A | | 7/1998 | Tax et al. | |

FOREIGN PATENT DOCUMENTS

| | | | | |
|---|---|---|---|---|
| FR | 1 513 543 | * | 2/1968 | 414/143.2 |

* cited by examiner

*Primary Examiner*—Janice L. Krizek
(74) *Attorney, Agent, or Firm*—Akin Gump Strauss Hauer & Feld, L.L.P.

(57) ABSTRACT

A portable elevator system for transporting a cargo container between a container cell and a mouth of the container cell is disclosed. The elevator includes a frame which is crane transportable and mountable on the mouth of a container cell in an open hold of the ship. A plurality of hoists are mounted on the frame. The hoists are releasably engageable with at least one container so as to transfer the container in either vertical direction through a central opening in the frame between a first location at a mouth of the container cell and a second location in the container cell. The container further includes a plurality of supports, which are releasably engageable with a container in the first location in addition to the engagement of the hoists. Additionally, a connector for connecting two adjacent containers in a single cell is disclosed. The connector is adapted to be transported to one of the two containers on one of the hoists. Upon engaging one container, the connector is released from the hoist and travels along the container until it reaches the second container. The connector then engages both the first and second containers, so that the first and second containers can be transported together by the hoists as a single container.

16 Claims, 14 Drawing Sheets

MODULAR CELL ELEVATOR FOR CONTAINERSHIP

This application claims the benefit of Provisional application No. 60/154,775, filed Sep. 20, 1999

BACKGROUND OF THE INVENTION

The present invention relates to a modular cell elevator for use on a containership in combination with a spreader bar and crane to load containers onto and to remove containers from the containership. The present invention also relates to connectors which connect two adjacent containers together to enable the containers to be simultaneously lifted with a single spreader bar.

Containerships frequently store containers in cells within the hold of the ship. A cell is a vertical compartment, generally several decks high, extending from a container storage deck inside the ship upward to a cell hatch on the weather deck of the ship. Each cell is generally sized to accommodate the length and width of shipping containers, which are generally constructed in standard sizes, such as those sizes specified by the International Standards Organization ("ISO"). The standard sizes are generally twenty feet, forty feet, and forty-five feet long.

Spreader bars, which are well known in the container handling industry, are the end effector of a crane used to "pick" and "place" cargo containers or other such loads. Spreader bars are typically attached by suitable means such as cables or hooks to cranes of various types (e.g., gantry cranes, boom cranes, straddle cranes etc.) or the like in order to move the cargo which has been engaged by the spreader bar from one desired site to another. Spreader bars are used all over the world in military and commercial applications.

One particular application of spreader bars in the cargo handling industry is for loading and unloading cargo to and from ships either docked in port or in an offshore loading/unloading facility. Typically, to pick a container from a cell on a containership, a hatch on the top of the cell is opened, providing access for the spreader bar to be lowered into the cell to engage the top-most container in a vertical stack of containers in the cell. The spreader bar must be carefully lowered through the hatch. Despite mechanical gathers at the top of the cells, even the best of operators generally must make several failed attempts before finally entering the cell. Once the spreader bar is inside the cell and immediately above the container, the connecting mechanisms located at the four corners of the spreader bar must be connected with the mating mechanisms of the container to thereby fasten the spreader bar to the top of the container. The container must be carefully lifted up the cell and through the hatch and then transported to its off-loaded location. The process must be repeated to remove subsequent containers in the cell. Similarly, to place a container into a cell, the container must be connected to the spreader bar as described above, and then lifted over the open cell. The container must then be carefully lowered through the cell hatch and into the cell. The container must then be released from the spreader bar and the spreader bar must then be carefully raised through the cell and the cell hatch, and then transported to another container for placing into a cell. The lowering and raising of the spreader bar through the cell hatch and the cell is a delicate and time-consuming process.

Occasionally, twenty foot containers are loaded into cells which are sized for forty foot or even forty-five foot containers. To maximize space, two twenty foot containers are loaded length-wise adjacent to each other in a single cell so that the two twenty foot containers can be stored in a space generally used by a single forty foot container. A twenty foot spreader beam must make two trips into the cell to load and/or off-load the two adjacent containers. However, if forty foot containers are also being transported, the spreader beam or other transport mechanism used to transport the containers between the cell and the weather deck must be adjustable or two different sized spreader beams and/or other transport mechanisms must be used.

It would be beneficial to develop a transfer mechanism that would eliminate the need for the spreader bar to be required to be raised and lowered through the cell hatch and the cell. Such a transfer mechanism would increase productivity significantly because it would ease the task of picking and placing containers. Also, since the transfer mechanism would work in parallel with the crane and spreader bar, the transfer mechanism would eliminate the need for the spreader bar to enter the hatch, a major portion of the crane cycle, and greatly reduce the time required to load and/or unload a containership.

It would also be beneficial to develop a connector, used in pairs, that would connect adjacent ends of two twenty foot containers to structurally form a single forty foot container so that a single forty foot spreader bar and/or other transport mechanism can be used without having to use a twenty foot spreader bar and/or other transport mechanism. Use of the connector would decrease loading/unloading cycle time by transporting two containers during each cycle and greatly increase productivity.

BRIEF SUMMARY OF THE INVENTION

Briefly, the invention is a modular cell elevator for transferring a container through a container cell mouth opening on a container ship, the frame having a central opening therethrough sufficiently large to pass a container fitting the cell vertically through the frame. The modular cell elevator comprises a frame mountable on a container cell in an open hold of the ship; a plurality of hoists mounted on the frame, the hoists being releasably engageable with at least one container so as to transfer the container in either vertical direction through the central opening between a first location proximal a mouth of the container cell and a second location below the frame in the container cell, and a plurality of supports on the frame releasably engageable with a container in the first location proximal the cell mouth so as to support the container in the first location separately from the hoists.

In another aspect, the invention is also a device to remotely connect a hoist to a cargo container in a vertical container cell comprising a cable having a first end and a second end, the first end being attached to the hoist; a roller attached to the second end of the cable, the roller being magnetically engageable with a vertical guide of the container cell located below the hoist, the roller guiding the connecting device along a length of the vertical guide between the hoist and a container located in the cell; a twist lock on the second end of the cable insertable into and being engageable with a corner fitting on the container; an actuator on the twist lock to engage the twist lock with the corner fitting; and a sensor located at the second end of the cable so as to sense the insertion of the twist lock into the corner fitting.

The invention is also a device to connect a first shipping container to a second, adjacent shipping container, the device being releasably connected to a hoist, the device disconnecting from the hoist upon engagement of the device with one of the first and second containers, the device comprising a carriage engageable with the one of the first and second containers to transport the connecting device from the hoist to a junction between the first container and the second container; a first coupler insertable into a first container corner fitting, the first coupler being rotatable between an unlocked position and a locked position in the first container corner fitting; a second coupler insertable into a second container corner fitting, the second coupler being rotatable between an unlocked position and a locked position in the second container corner fitting; an actuator operably connected to the first and second couplers to insert the first coupler into the first corner fitting and to lock the first coupler to the first corner fitting and to insert the second coupler into the second corner fitting and to lock the second coupler to the second corner fitting, respectively; and a sensor located to sense the first and second couplers being positioned to be insertable into the first and second corner fittings, respectively, the sensor providing a signal to the actuator to insert the first coupler into the first corner fitting and to lock the first coupler to the first corner fitting, and to insert the second coupler into the second corner fitting and to lock the second coupler to the second corner fitting.

The invention is also a method of transferring a container between a first location at a mouth of a container cell wherein a lower end of the container is engaged by a plurality of supports and a second location in the container cell of a container ship, the method comprising the steps of releasably mounting a frame on a container cell in an open hold; releasably connecting at least one hoist mounted on the frame to a container; transferring the container between the first location and the second location with the hoist; moving a plurality of supports on the frame between a container engaged and a container disengaged position; and releasing the at least one hoist from the container.

The invention is also a method of connecting a first container to a second, adjacent container, the method comprising the steps of releasably connecting a hoist to one of the first and second containers; releasing a device from the hoist to connect a first shipping container to a second, adjacent shipping container; transporting the device from the hoist to the other of the first and second containers such that the device extends over the first and second containers; and releasably connecting the device to the first container and the second container.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
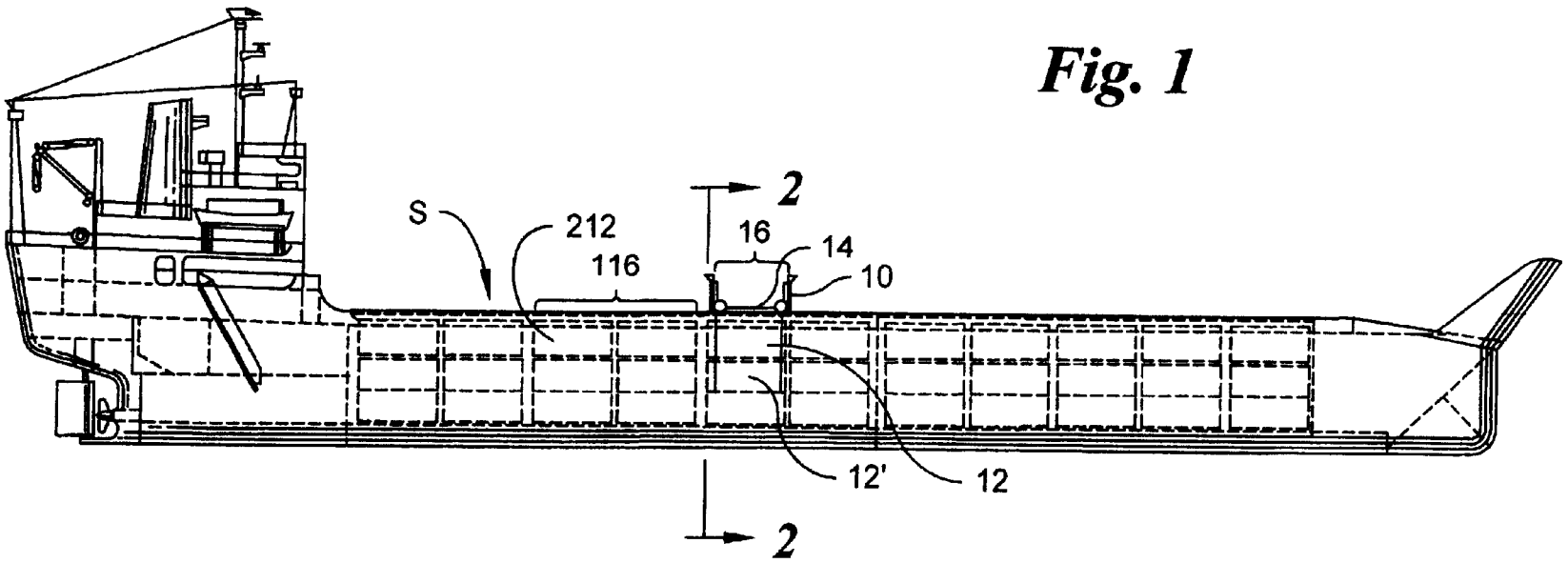
FIG. 1 is a side view, partially cut away, of a containership with a modular cell elevator of the present invention.

In the drawings, like numerals are used to indicate like elements throughout. The words "inwardly" and "outwardly" refer to directions toward and away from, respectively, the geometric center of a modular cell elevator and designated parts thereof. The words "upper", "lower", "left" and "right", as used herein, designate directions in the drawings to which reference is made. The word "a" as used herein is defined as "at least one". The terminology includes the words above specifically mentioned, derivatives thereof and words of similar import. In the drawings, like numerals are used to indicate like elements throughout.

Figure 2:
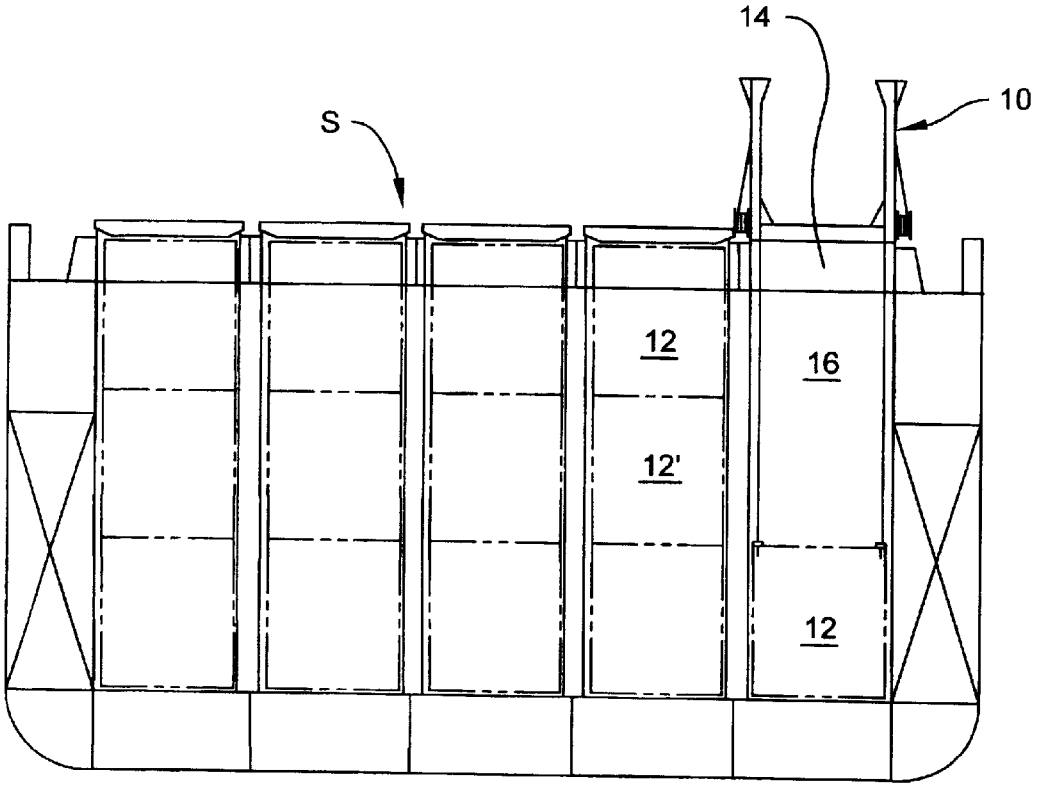
FIG. 2 is a sectional view of the containership taken along line 2—2 of FIG. 1.

Referring to FIGS. 1 and 2, a modular cell elevator 10 ("elevator") according to a preferred embodiment of the present invention transfers a container 12 between a first location proximal or at a mouth or hatch opening 14 of a container cell 16 on a container ship S, and a second location below the elevator and within the container cell 16 ("cell"). The elevator 10 can be used during loading ("placing") of the container 12 onto the ship and into the cell 16 and also during offloading ("picking") of the container 12 from the ship and the cell 16. Typically, the container 12 is one of an ISO standard size of twenty feet, forty feet, or forty-five feet in length, although those skilled in the art will realize that containers 12 can also be of other lengths.

Figure 5:
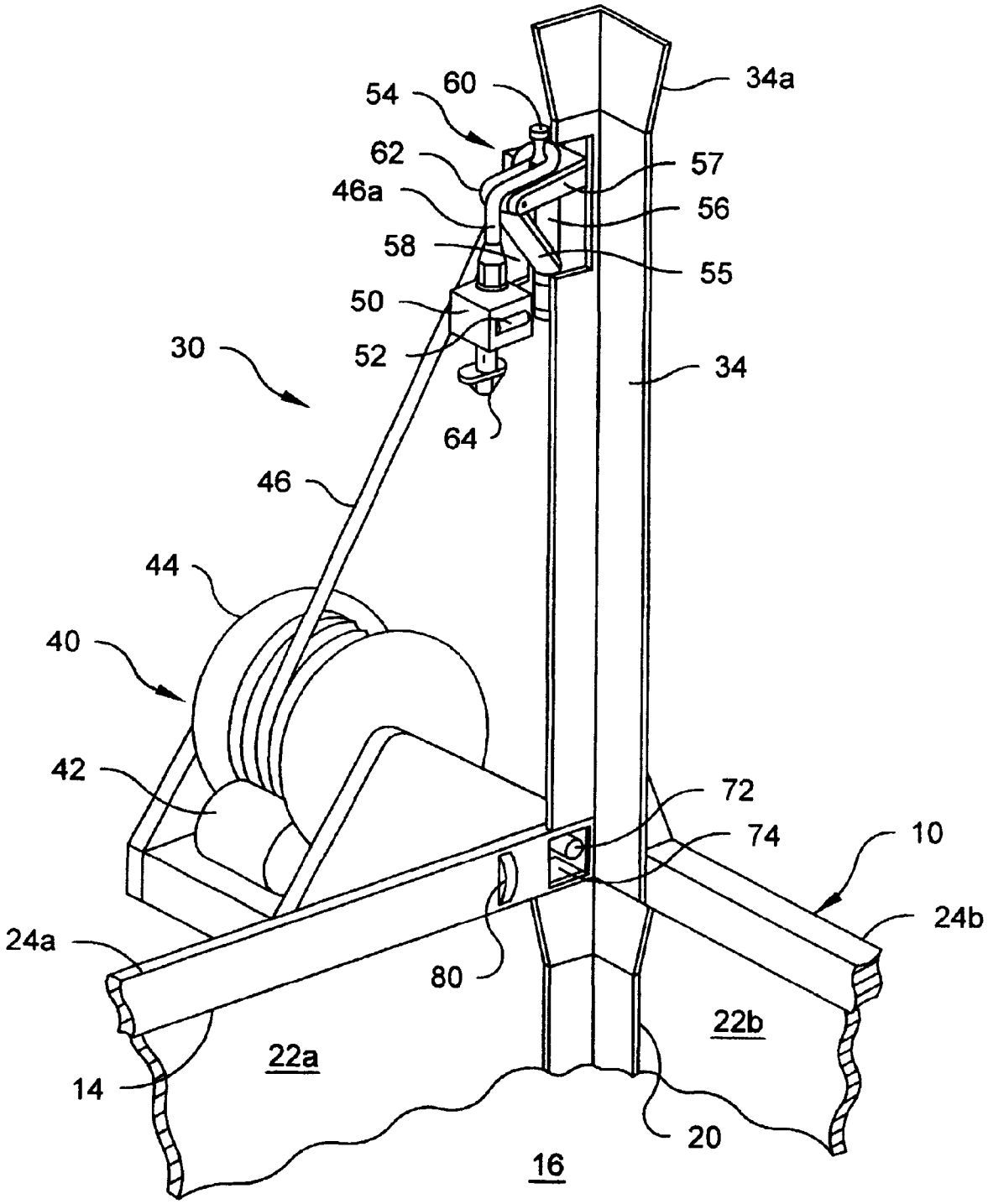
FIG. 5 is a perspective view of one hoist of the modular cell elevator, located over the corner of the containership cell, with a hoist swung away from the cell in a standby position.
Figure 6:
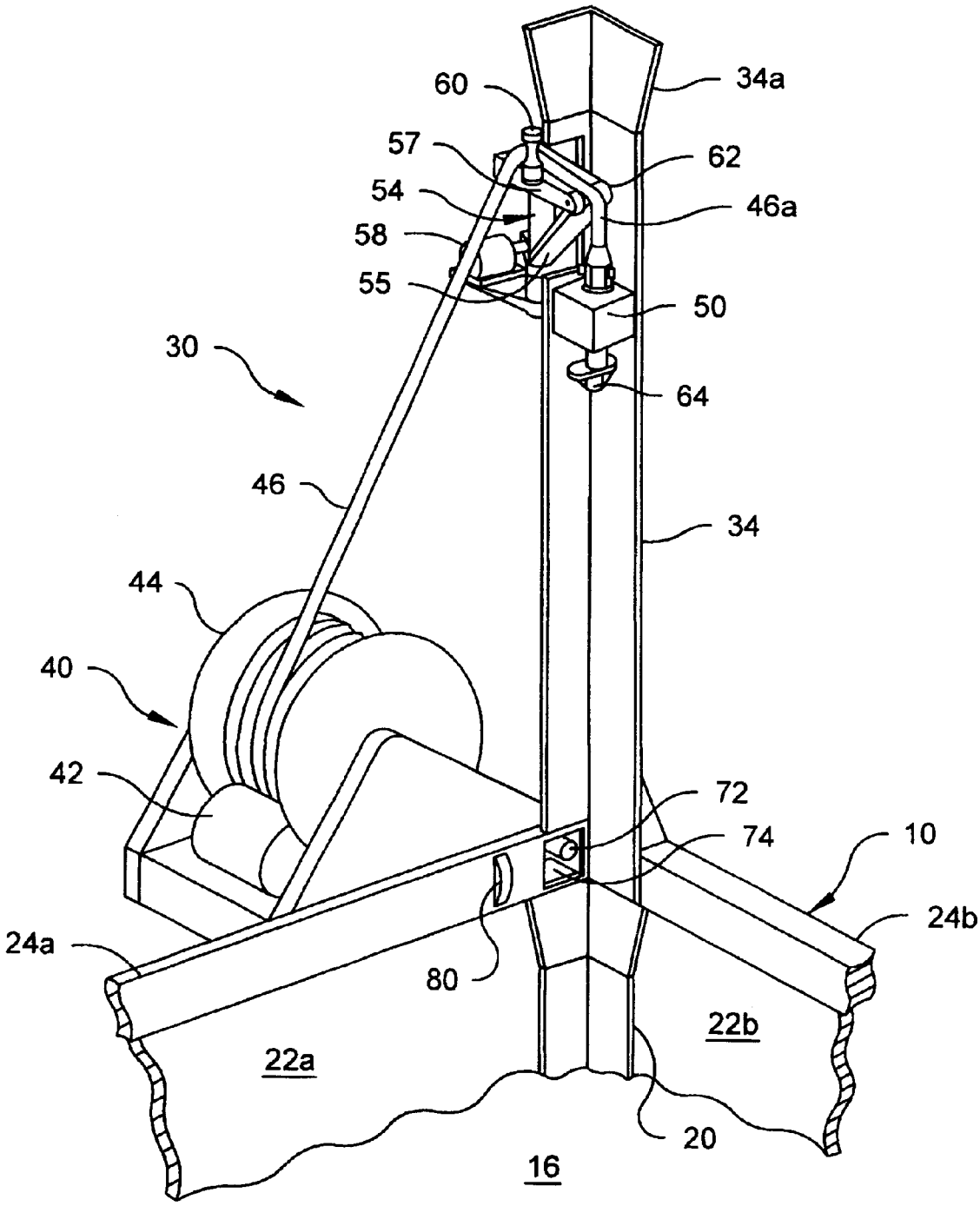
FIG. 6 is an enlarged perspective view of the corner of the modular cell elevator located over the corner of the containership cell, with the hoist swung over the cell in a hoisting position.
Figure 7:
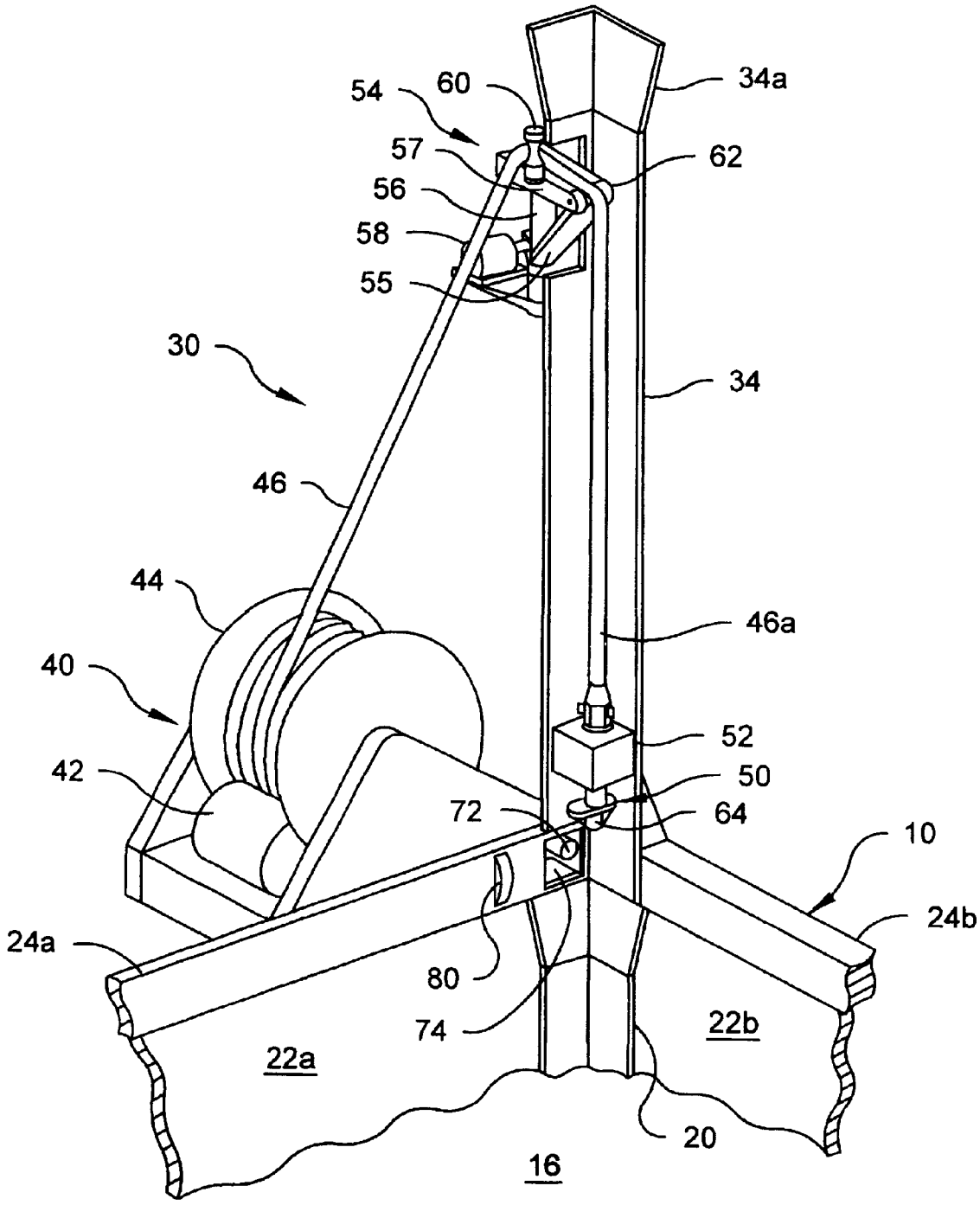
FIG. 7 is a perspective view of the corner of the modular cell elevator located over the corner of the containership cell, with a magnetic roller and twist lock lowered part way down a cell guide.

Referring to FIGS. 5–7, each cell 16 includes at least four cell guides 20 which extend between the top and the bottom of the cell 16 (only one cell guide 20 shown), with each cell guide 20 located at one corner of the cell 16. The cell guides 20 are preferably in the form of angle steel, the top ends of which are outwardly flared to more easily receive a container 12. The cell guides 20 generally define the length and width of the cell 16. Bulkheads 22*a,* 22*b* can be installed between longitudinally and laterally adjacent cell guides 20 to further define a cell 16, but those skilled in the art will realize that such bulkheads 22*a,* 22*b* are not necessary.

Figure 3:
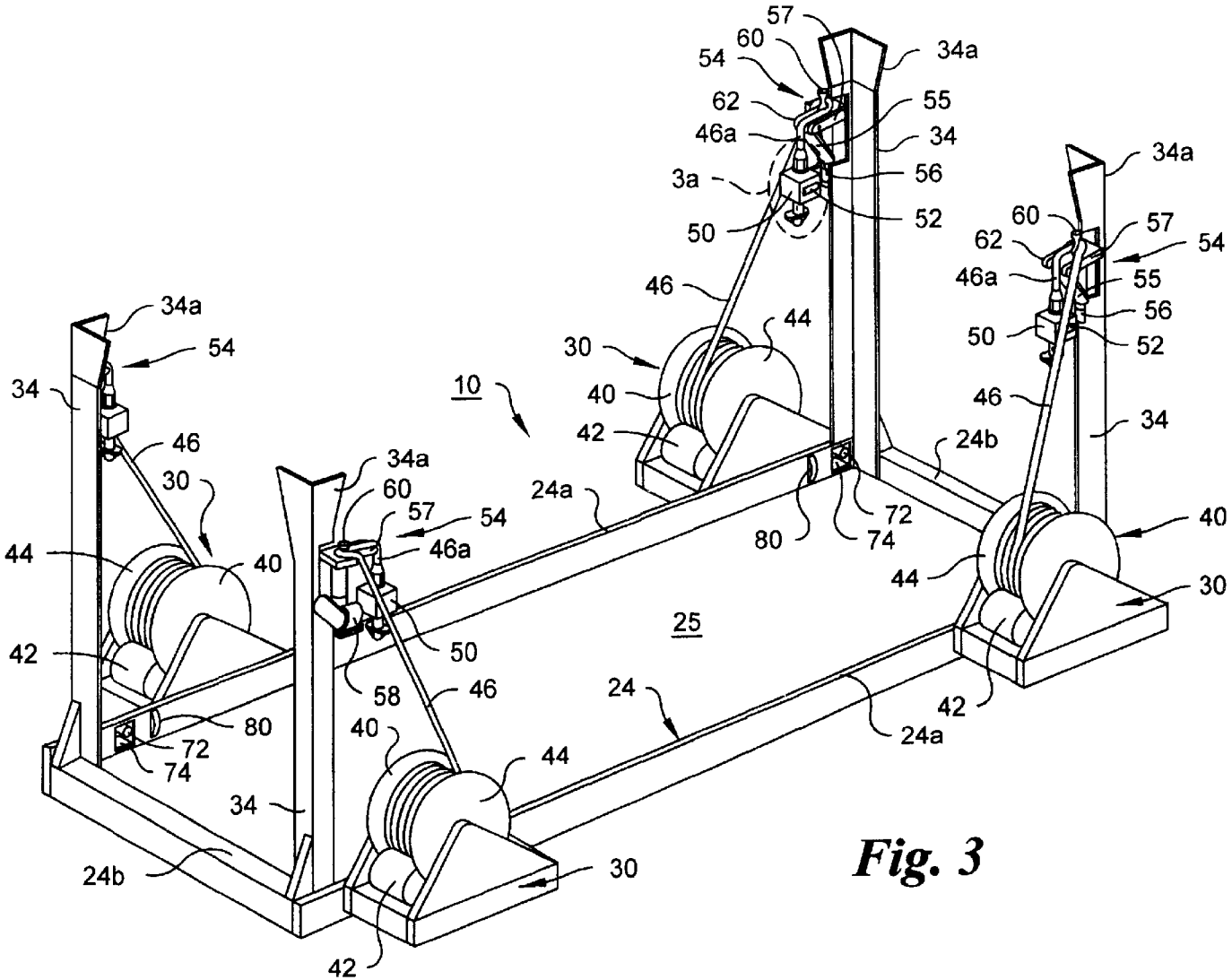
FIG. 3 is a perspective view of the modular cell elevator for a containership in accordance with a preferred embodiment of the present invention.

Referring now to FIG. 3, the elevator 10 includes a generally rectangular shaped open frame 24 having a base 32 with two opposing longitudinal sides 24*a* and two opposing lateral sides 24*b* surrounding and defining a central opening 25 through the frame 24. The frame 24 is mountable over the cell 16 at the hatch opening 14. Preferably, an inside area of the frame 24 includes the central opening 25 at least slightly longer and wider than the particular containers 12 which are being transported so that the containers 12 can pass through the frame 24. The exterior of the frame 24 is preferably sized to nest in the flared upper ends of the cell guides 20.

The frame 24, when connected to a spreader bar 26 with twist locks 28 as will be described more in detail herein (and shown in FIG. 9), is preferably transportable between different cells and between a cell 16 and a location off the ship, such as a pier, a dock, or even another ship, by suitable means such as the crane provided to move the containers 12. However, those skilled in the art will realize that the frame 24 or a plurality of frames 24 can be fixedly connected to the deck on the ship over a cell 16 or a plurality of cells 16 or mounted for movement along and/or across the deck on a suitable carriage (not shown) to service the various cells.

As shown in FIG. 3, the frame 24 preferably includes cell guide extensions 34 which extend upward from each of the four corners of the base 32 of frame 24. The cell guide extensions 34 are preferably at least as high as the height of the container 12. The cell guide extensions 34 are preferably angle steel and more preferably the same size as the angle steel making up the cell guides 20. The top 34*a* of each cell guide extension 34 is again flared outward from the frame 12, such that the space bounded by the tops 34*a* of the cell guide extensions 34 is larger than the central opening 25 through base 32. The flared tops 34*a* provide a funnel effect to allow containers 12 and the spreader bar 26 to easily enter the space between the cell guide extensions 34 to line up the container 12 with the opening 25 in the frame 24. In the figures, the flare is slight, but those skilled in the art will realize that the flare can be larger to provide a more pronounced funnel effect.

Preferably, the base 32 and the cell guide extensions 34 are constructed of a high strength steel or other suitable material and treated with an outer coating to protect against rust and corrosion from rain, salt and other corrosives which might structurally weaken the frame 24 and the cell guide extensions 34.

Figure 4:
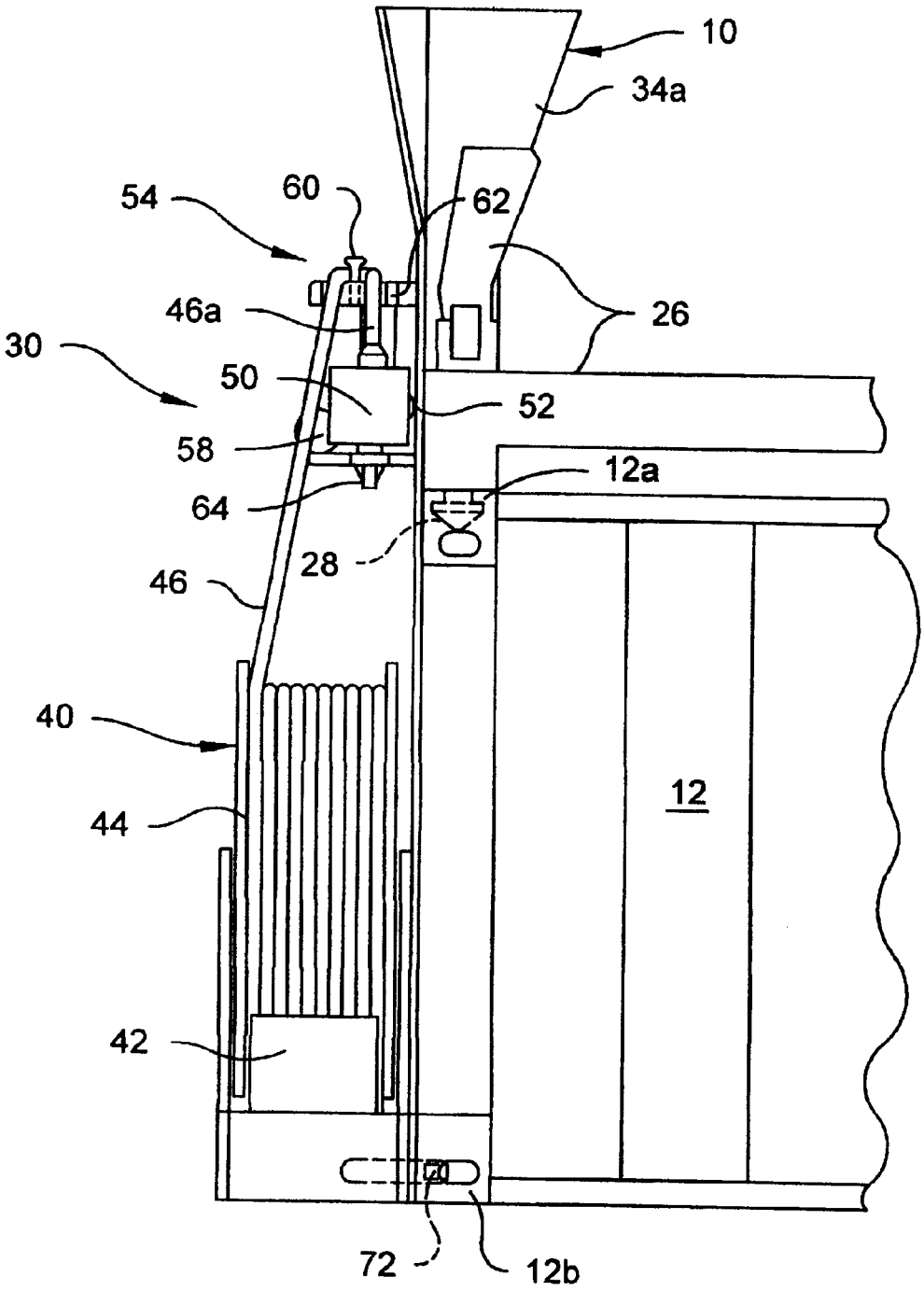
FIG. 4 is a side view, partially cut away, of the elevator located over a corner of a containership cell, with the container connected to a spreader bar and a connecting pin engaging the container.

The elevator 10 preferably further includes four lifting devices or hoists 30, which are each preferably disposed proximate to one of four corners of the frame 24. The hoists 30 transport containers 12 between the frame 24 and the interior of the cell 16. The hoists 30 are configured to releasably engage a mechanism on the top of the container 12, preferably upper corner castings 12*a* of the container 12, one of which is shown in FIG. 4. Corner castings 12*a* are the standard fittings at the corners of ISO containers. Preferably, the hoists 30 include locking mechanisms which will be more fully described herein.

Figure 11:
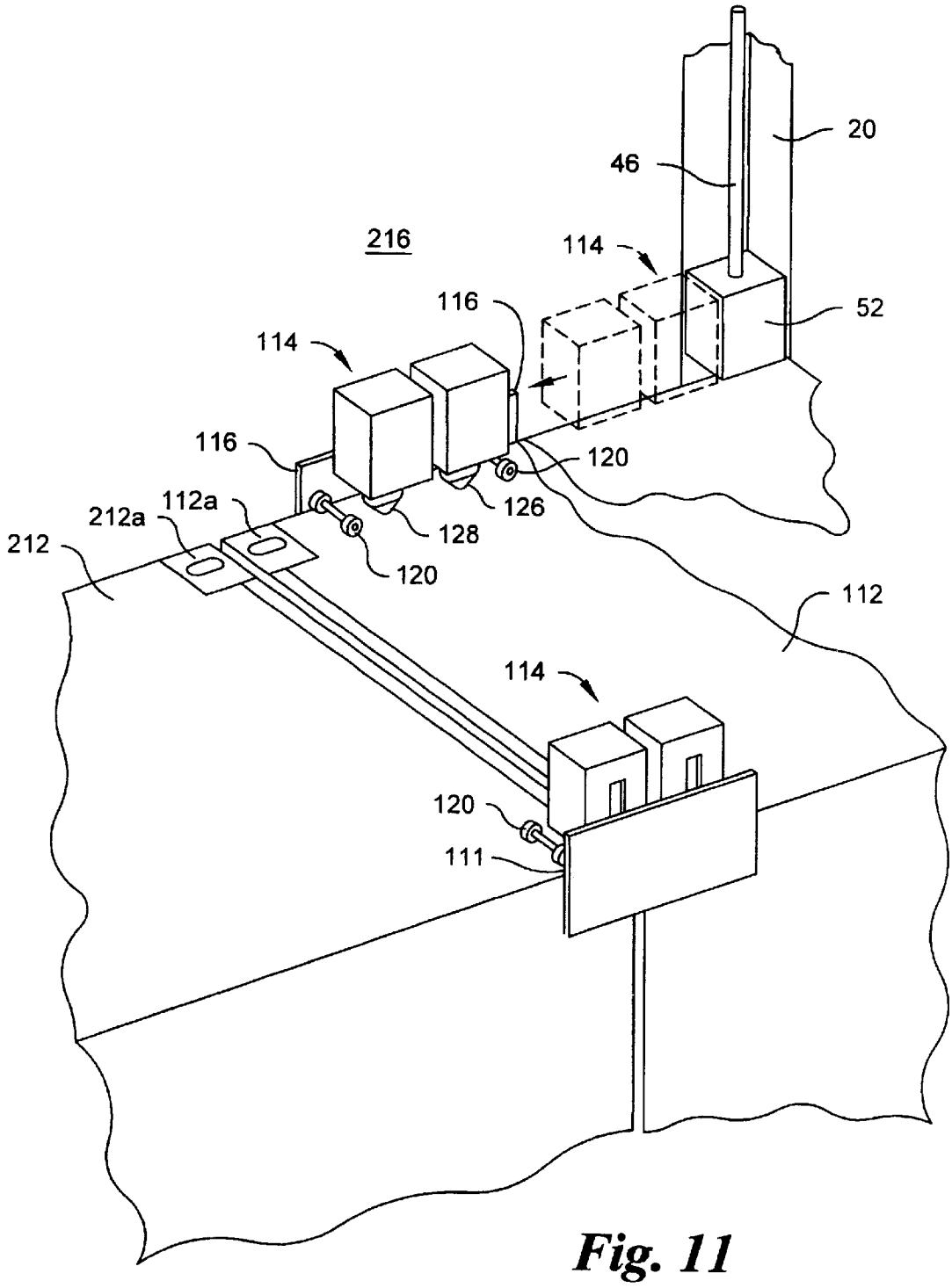
FIG. 11 is a perspective view of the connector moving into a locking position on the first and second containers.

Each hoist 30 further preferably includes, at each corner proximate to the cell guide extension 34, a winch 40. The winch 40 includes a winch motor 42, a winch reel 44 rotatably mounted to the frame 24 and driven by the motor 42, and winch cable 46 wound on the winch reel 44. The winch cable 46 can simply be wire rope, which is well known, but preferably, the winch cable 46 includes lines (not shown), preferably integrated with the load bearing portion of the cable 46, which can transmit electrical power, hydraulic power, and/or signals for reasons that will become apparent. A first or connected end (not shown) of the winch cable 46 is fixedly attached to the winch reel 44. A second or free end 46*a* of the winch cable 46 is attached to a connector preferably in the form of a twist lock 50 and preferably one with one or more magnetic rollers 52 as will be described. The twist lock 50 includes a key 64 which is insertable into and engageable with the top side of an upper corner casting 12*a* on the container 12. The top side of an ISO standard upper corner casting is indicated in FIG. 11 at 112*a* and 212*a*.

Preferably, each hoist 30 includes a twist lock stowage rotator ("rotator") 54 which preferably is mounted on each cell guide extension 34 proximate to the flared top 34*a*. The rotator 54 is rotatable about a vertical pivot 56 between a standby position as shown in FIG. 5 on one side of the interior angle defining the extension 34 and a hoisting position as shown in FIG. 6 within the interior area (i.e., right angle area) of the angle. The rotator 54 preferably includes a truss 55 and a horizontal arm 57, which can be manually rotated on the pivot 56. Preferably, the rotator 54 includes an actuator 58 for remote control, and more preferably, automatic remote control pivoting of the arm 57. The actuator can be of virtually any design desired to rotate the rotator 54 approximately 90° between stowed or standby position and an extended or hoist position. Also, the rotator can be spring-loaded to one configuration and only moved by the remotely or automatically controlled actuator to the other configuration. The rotator 54 includes a first generally vertical axis pulley 60 and a second generally horizontal axis pulley 62, mounted on the arm 57, which redirect the winch cable 46 from a generally upward direction outside the frame 24 to a generally downward direction inside the frame 24. The winch cable 46 is drawn from the winch reel 44 over the rotator 54 and the first and second pulleys 60, 62 so that the free end 46*a* of the winch cable 46 and the attached twist lock 50 extends down from the second pulley 62 generally parallel to the cell guide extension 34.

Figure 8:
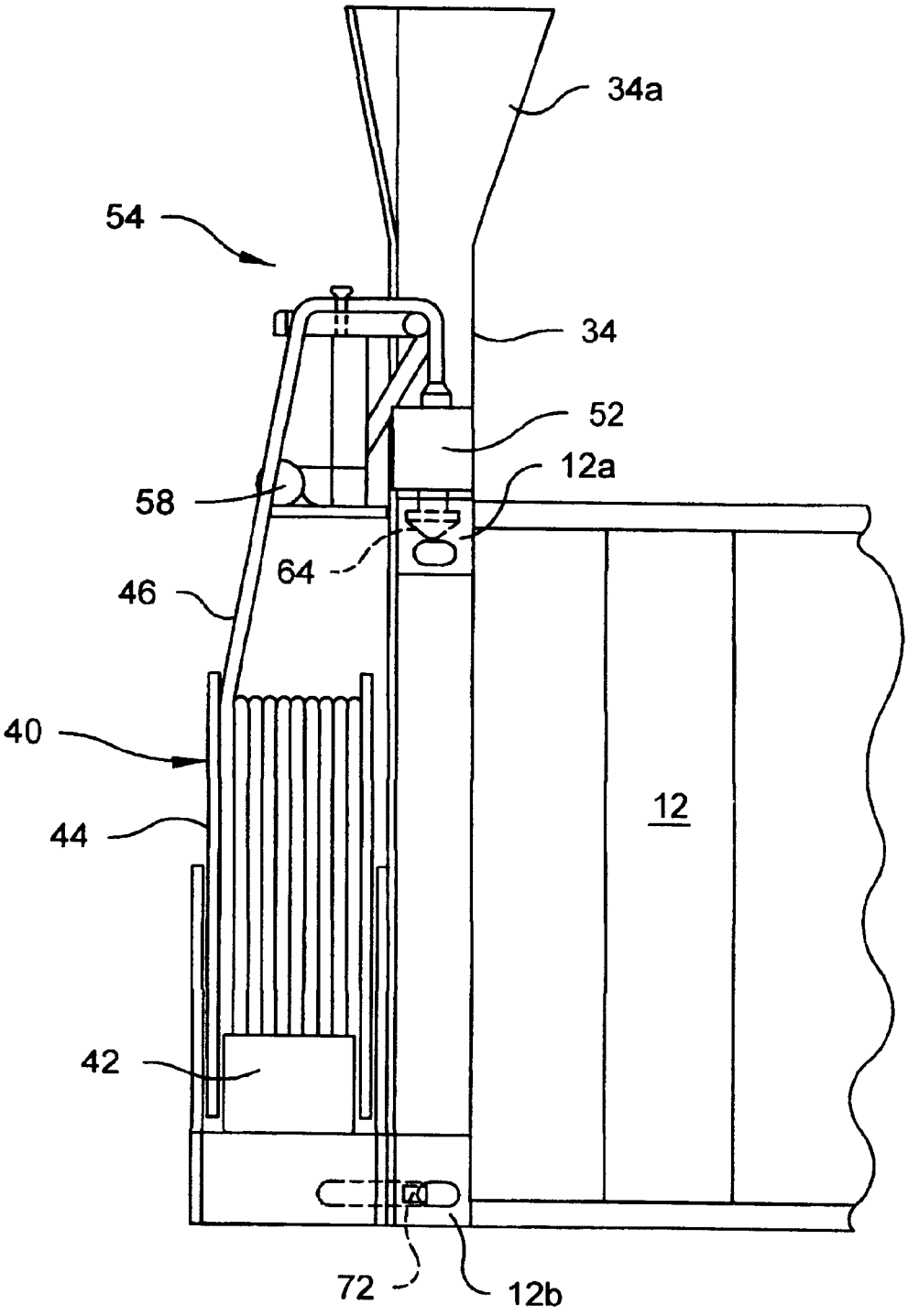
FIG. 8 is a side view, partially cut away, of a hoist with a container connected to the hoist and a connecting pin engaging the container.

Twist locks are standard components in the container handling industry and include "bayonet-type" shear keys 64 that fit into the upper corner castings 12*a* of the container 12, as shown in FIG. 8. When inserted into an upper corner casting 12*a,* an actuator 68, shown in phantom in FIG. 3*a,* within the twist lock rotates the key 64 to lock the key 64 into the upper corner casting 12*a*. In the preferred embodiment of the present invention, the twist locks 50 are hydraulically actuated to effect the required rotational movement and are connected by hydraulic hoses (not shown) to a remote hydraulic system (not shown). The hydraulic hoses can be contained within the winch cable 46 or can be separate from the winch cable 46. Although a hydraulic system is preferred, those skilled in the art will realize that other types of systems, such as electrical, can be used as well.

Figure 3A:
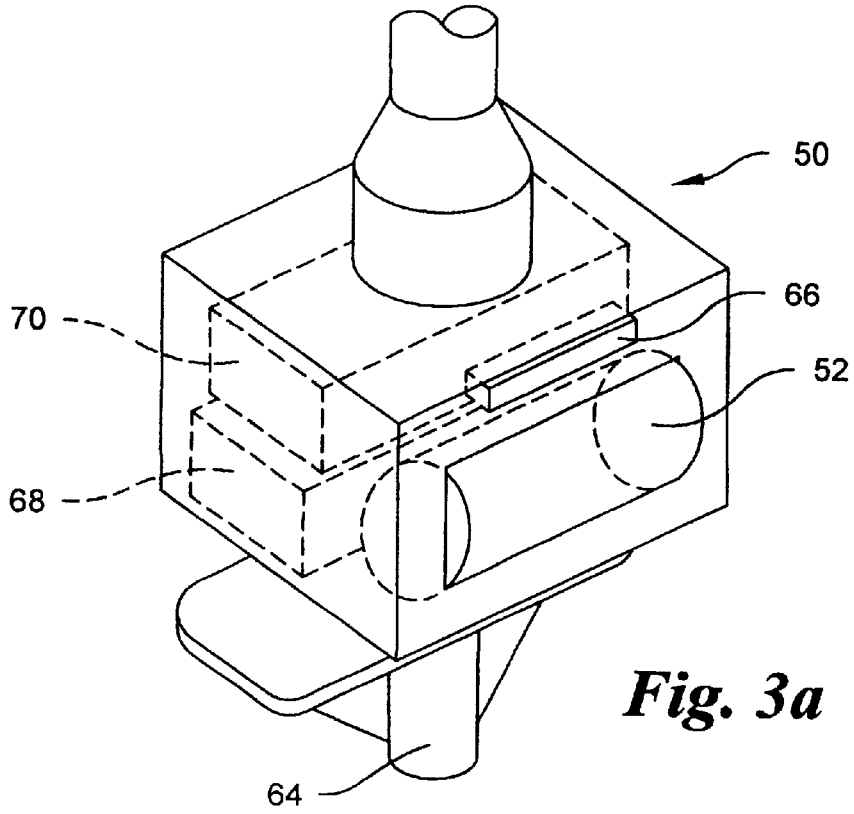
FIG. 3*a* is an enlarged perspective view of a twist lock with a magnetic roller.

As shown in FIG. 3*a,* a preferred twist lock 50 of the invention includes a housing 51 supporting the protruding shear key 64. The housing 51 includes the twist lock actuator 68 (in phantom), which rotates the key 64. The housing 51 further preferably mounts one or more magnetic rollers 52, which are partially exposed through the housing outer wall(s) facing the cell guide extensions 34 and cell guides 20 when the twist locks 50 are being raised from and lowered into a cell. The twist lock 50 preferably further includes in housing 51, a sensor 66 (shown in phantom) preferably also located so as to sense the insertion of the twist lock 50 into the upper corner casting 12*a*. Upon proper insertion of the key 64 into the respective upper corner castings 12*a*, the sensor 66 signals the insertion to an operator (not shown) controlling the elevator 10, who may be the crane operator, another operator, or an automatic control system (not shown). A jogging mechanism 70 (shown in phantom) preferably is located in housing 51 of the twist lock 50 and is operatively connected to the sensor 66 so as to jog the twist lock 50 when the sensor 66 senses that the shear key 64 has failed to nest in or mate with the upper corner casting 12*a*. The jogging mechanism 70 jogs the twist lock 50 until the shear key 64 properly nests in the upper corner casting 12*a*. The jogging mechanism 70 can be a vibrator, a solenoid, or other mechanism which can jog the twist lock 50 upon activation.

In the hoisting position as shown in FIG. 6, the magnetic rollers 52 are engageable with the sides of the proximate cell guide extension 34. The magnetic rollers 52 keep the twist lock 50 aligned in the cell guide extension 34 and then in the cell guides 20 as the twist lock 50 with magnetic rollers 52 is lowered or raised by the winch reel 44. If the winch cable 46 can transmit electrical power and/or signals, the twist lock 50 with magnetic rollers 52 can be operated remotely, such as by an operator outside of the cell 16 through the cable. The actuator 50 can also be configured for wireless control.

As shown in FIG. 3, the frame 24 preferably also includes at least four corner casting pins 72 (only two seen) for releasably engaging upper or lower corner castings 12*a* or 12*b* of the container 12 and supporting the container 12 on the frame 24 when the container 12 is in the first location. The casting pins can be located on the longitudinal sides 24*a* of the frame 24, the lateral sides 24*b* of the frame 24, or a combination thereof including both at each corner but at least one pin 72 must be located proximate to each corner of the frame 24 and be movable on the frame 24, preferably horizontally, between a container disengaged position and a container engaged position. In the container disengaged position shown in FIG. 3, the corner casting pins 72 are each retracted into a recess 74 in the frame 24, such that no part of the corner casting pins 72 extend beyond the frame 24 into the central opening 25. In one container engaged position, shown in FIG. 8, which will be further discussed below, the corner casting pins 72 (shown in phantom) extend from the frame 24 into the central opening 25 and into the lower corner castings 12*b* of the container 12, which are located in standard locations proximate to the bottom of the sides at the corners of ISO containers. Each pin 72 is preferably operably coupled with a sensor 73 which senses when the weight of a container 12 is on the respective pin 72. The pins 72 can be rotatable shear keys similar to the shear keys 64 in the twist lock 50 to lock the pins 72 into the lower corner castings 12*b*, or the pins 72 are, more preferably, merely straight members that do not lock with the corner casting 12*a* or 12*b* but are merely inserted into one of the side openings of corner castings 12*a*, 12*b*.

Figure 4A:
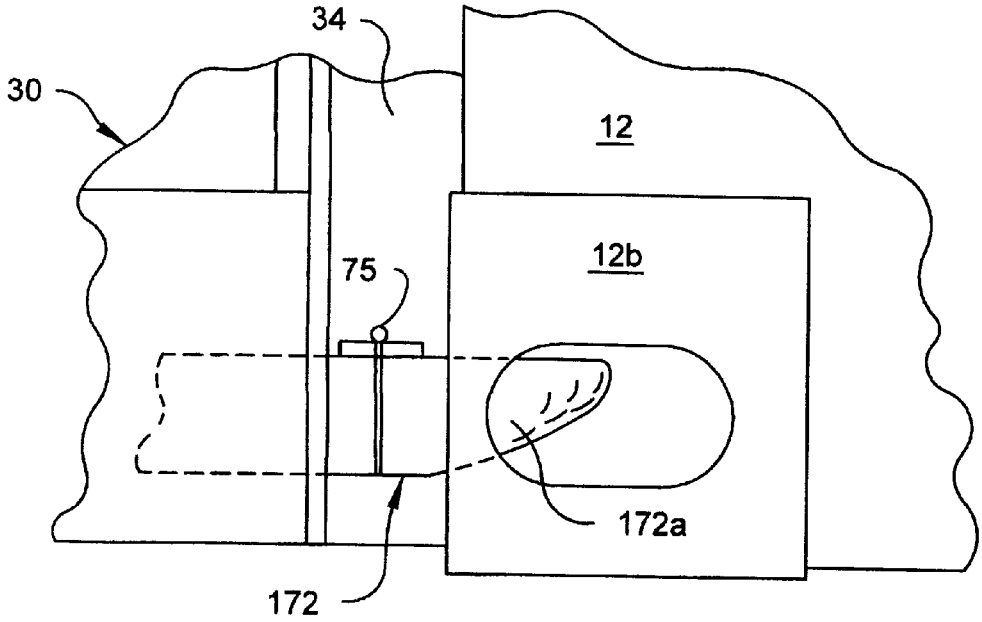
FIG. 4*a* is an enlarged side view, partially cut away, of the container connected to the elevator by an alternate design of a lower corner casting pin.

Referring to FIG. 4*a*, an alternate design of a corner casting pin 172 is depicted. Pin 172 can include a hinge 75 which, with the pin 172 in an extended position, is located between the frame 24 and the lower corner casting 12*b* of the container 12. The hinge 75 allows a free end 172*a* of the pin 172, inserted in the lower corner casting 12*b*, to pivot upward about the hinge 75 but not pivot downward to allow the container 12 to be lifted without retraction of pin 172.

Figure 9:
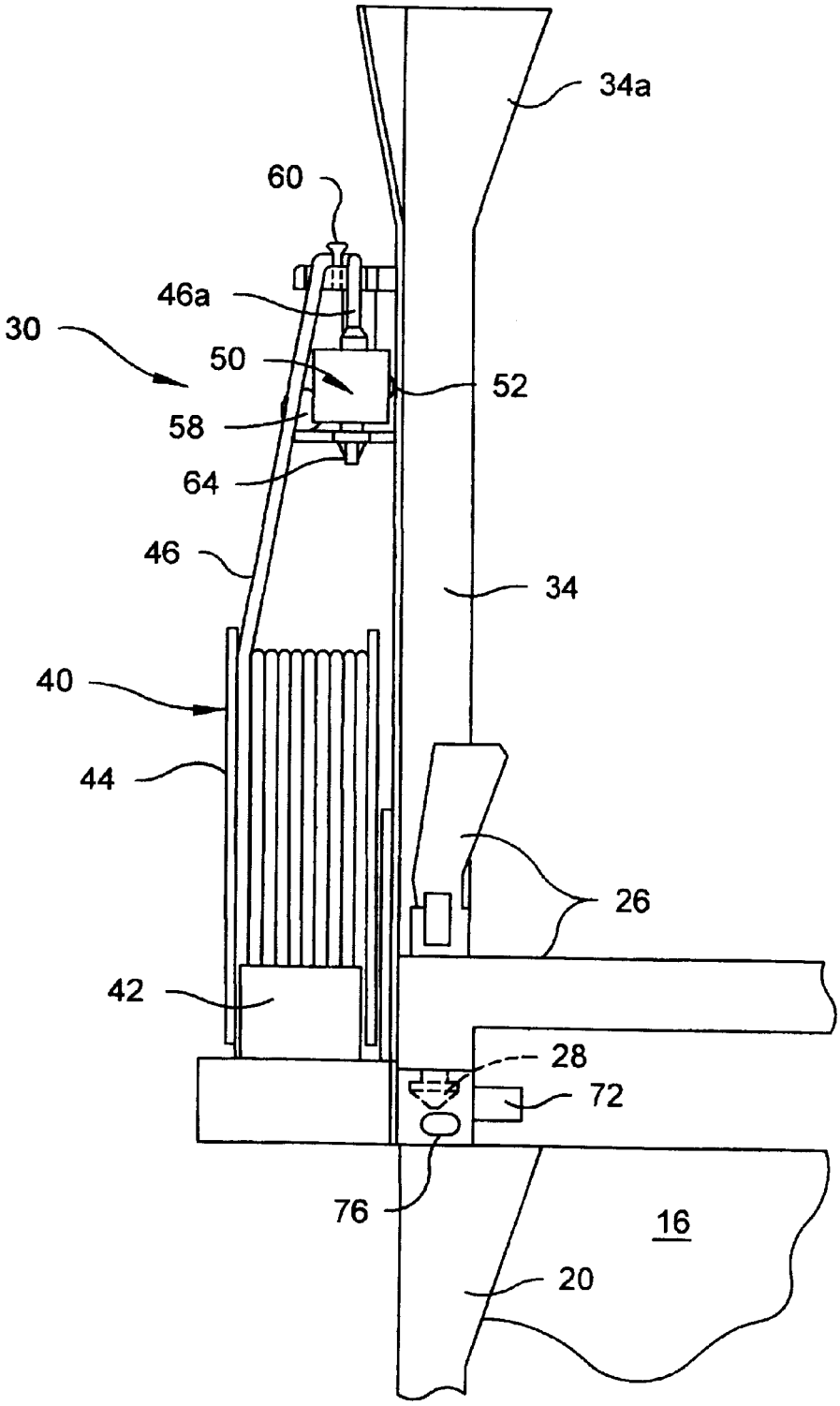
FIG. 9 is a side view, partially cut away, of the spreader bar engaged with the modular cell elevator.

As shown in FIG. 9, the corner casting pins 72 are preferably designed to also super-extend from the frame 24 to expose corner castings 76 over the pins 72 that match top corner castings 12*a* in ISO containers. The corner castings 76 enable twist locks 28 on a spreader bar 26 to latch on to the frame 24 to transport the frame 24 by crane from one location to another. The lower corner casting pins 72 are preferably hydraulically actuated, although those skilled in the art will realize that other methods of actuation such as pneumatic or electric, including, but not limited to, a solenoid or a linear screw motor, can be used.

Referring back to FIG. 3, the frame 24 includes at least one, and preferably four, container sensors 80 (only two are seen), which are mounted on the frame 24 facing inward toward the opening 25. Each sensor 80 detects when a container 12 passes by the sensor 80. Each of the preferred four sensors 80 is located proximate to a separate one of the hoists 30. The container sensors 80 preferably are light beam operated, and, more preferably, infra-red light beam operated, which is known to those skilled in the art. However, those skilled in the art will realize that the container sensors 80 can be a spring loaded switch, proximity detector or other type of sensors suitable for detecting when the container 12 passes by the sensors 80. The container sensors 80 preferably are located and configured to sense when the corner castings 12*a* or 12*b* are aligned with the corner casting pins 72 and may be operatively connected with actuators moving the corner casting pins 72 to engage the corner casting pins 72 with the corner castings 121. Although four sensors 80 are preferred, those skilled in the art will realize that more or less than four sensors 80 can be used.

The operation of the elevator 10 will now be discussed. It is immaterial whether the crane is located on the ship to which the frame 24 is lowered, on another adjacent ship, or on an adjacent shore-based location, such as a pier or a dock. The hatch to a selected cell 16 is opened, allowing vertical access to the cell 16 from the weather deck. The corner casting pins 72 are super-extended from the frame 24 so that the corner casting 76 on each of the corner casting pins 72 is projecting inwardly from the frame 24. The spreader bar 26 is lowered to the frame 24 by the crane so that the twist locks 28 on the spreader bar 26 engage the support pin corner castings 76. The spreader bar 26 is then locked onto the frame 24 which can then be lifted by the crane. The frame 24 is moved from its existing location and lowered to the desired cell 16 by the crane/spreader bar combination such that the frame 24 generally surrounds the cell mouth 18 at the hatch opening 14 as shown in FIGS. 1 and 2. When the frame 24 is properly located, the frame 24 is released from the spreader bar 26 so that the frame 24 is releasably mounted (i.e. rests) in the mouth 18 over the desired cell 16. The corner casting pins 72 are then retracted into the frame 24 so that no portion of the corner casting pins 72 are projecting from the frame 24.

To remove a container 12 from the cell 16, the four rotators 54 are rotated from a standby position as shown in FIG. 5 to a hoisting position as shown in FIG. 6. The following description will describe the operation of only one hoist 30 located in one corner of the elevator 10 but pertains to each of the hoists 30 located at each of the four corners of the elevator 10.

The rotator 54 is rotated about the pivot 56 from the standby position to the hoisting position within the cell guide extension 34 so that the magnetic roller(s) 52 magnetically attaches itself to the cell guide extension 34. The magnetic roller(s) 52 engages the cell guide extension 34 and keeps the twist lock 50 aligned in the cell guide extension 34 as the twist lock 50 is lowered toward the cell 16 by the winch. The winch motor 42 is energized, rotating the winch reel 44 to play out the winch cable 46. The first and second pulleys 60, 62 change the direction of the winch cable 46 so that, as the winch cable 46 is played out from the winch 40, the roller equipped twist lock 50 is lowered down the cell guide extension 34 as shown in FIG. 7. When the twist lock 50 reaches the cell 16, the magnetic roller 52 engages with the cell guide 20. The magnetic roller 52 guides the twist lock 50 along the height of the cell 16 between the top of the cell 16 and the top container 12. The force between the magnetic roller 52 and each of the cell guide 20 and the cell guide extension 34 is sufficient to keep the twist lock 50 aligned in the cell guide 20 and the cell guide extension, but not so strong as to prevent the twist lock 50 from being lowered as the winch cable 46 is played out.

The twist lock 50 shear key 68 contacts the corner casting 12*a* in the top of the container 12. The sensor 66 on the twist lock 50 sends a signal to the winch motor 42 to let out a small amount of additional winch cable 46 to give the twist lock 50 enough slack for the shear key 68 to enter the corner casting 12*a*. When the sensor 66 detects that the twist lock 50 has entered the corner casting 12*a,* the sensor 66 sends a signal to stop the winch motor 42. Additionally, the sensor 66 sends a signal to the twist lock hydraulic system (not shown) to activate the hydraulic system to rotate and engage the shear key 64 of the twist lock 50 with the container upper corner casting 12*a* in a manner which is well known in the art. If the sensor 66 senses that the twist lock 50 is not properly engaged with the shear key 68 located within the container upper corner casting 12*a,* the sensor 66 activates the jogging mechanism 70 to jog the twist lock 50 to nest the shear key 64 in the container upper corner casting 12*a* prior to sending a signal to rotate and engage the shear key 64 in the container upper corner casting 12*a*. The hoist 30 is now releasably connected to the container 12.

When all four twist locks 50 are engaged with their respective upper corner castings 12*a,* the winch motors 42 are operated in a reverse direction, rotating the winch reels 44 to reel in the winch cables 46. The reeling in of the winch cables 46 lifts the twist locks 50 and the container 12 upward toward the hatch opening 14, transferring the container 12 from within the cell 16 to the frame 24 located at the top of the cell 16.

The container is 12 lifted by the hoists 30 from the cell 16 past the hatch opening 14 preferably until the container sensors 80 sense that the lower corner castings 12*b* are aligned with the corner casting pins 72. Each container sensor 80 sends a signal to stop the proximal winch reel 44 and to extend the proximal corner casting pins 72 from the container disengaged position in the frame 24 to the container engaged position, extending inwardly into the central opening, locking each of the corner casting pins 72 into the container engaged position in a respective lower corner casting 12*b* of the container 12 as shown in FIG. 8. After the corner casting pins 72 have fully extended into their respective lower corner castings 12*b,* the winch motor 42 again reverses to play out a sufficient amount of winch cable 46 to settle the weight of the container 12 onto the corner casting pins 72. Alternatively, instead of locking the corner casting pins 72 into the lower corner castings 12*b,* the container 12 can be lifted sufficiently above the corner casting pins 72 so that the bottom of the container 12 is above the corner casting pins 72. The corner casting pins 72 are then extended from the frame 24, and the container 12 is then lowered on top of the corner casting pins 72. Such an alternative method eliminates the need to exactly align the lower corner castings 12*b* with the corner casting pins 72.

Once the container 12 is supported by the corner casting pins 72, sensors 73 in the pins 72 sense that the weight of the container 12 is on the pins 72 and send a signal to the twist lock hydraulic system to disengage the shear keys 64 of the twist locks 50 from each upper corner casting 12*a*. After the twist lock 50 has disengaged from the upper corner casting 12*a,* the winch motor 42 activates to reel in a sufficient amount of winch cable 46 to fully raise the twist lock 50 above the top of the container 12. The rotator 54 then rotates from the hoisting position to the standby position.

After all four rotators 54 are rotated to the standby position, the spreader bar 26 can be lowered by the crane onto the top of the container 12. The spreader bar 26 is connected to the container 12 in the known manner as shown in FIG. 4. After the spreader bar 26 is fully connected (at all four corners) to the container 12, the crane lifts the spreader bar 26 and the container 12 from the frame 24 sufficiently to lift the weight of the container 12 from the corner casting pins 72, which are then retracted into the frame 24 to the container disengaged position. The container 12 is then lifted from the frame 24 by the crane/spreader bar combination for placement in a remote location.

Alternatively, if the alternative lower corner casting pins 172 shown in FIG. 4*a* are used, after the spreader bar 26 is connected to the container 12, the spreader bar 26 can lift the container 12 from the frame 24 without the need for the lower corner casting pins 172 to retract into the frame 24. As the container 12 is being lifted, each lower corner casting pin 172 pivots upward about its respective hinge 75, allowing the pin 172 to slip out of the lower corner casting 12*b*. Indeed, the pins 172 can be left extended virtually all the time and retracted only to pass a container down through the central opening 25.

While the container 12 is being transported from the frame 24 to the remote location, the removal process can be repeated with a second container 12', shown in FIG. 1, which was stacked below the container 12 within the same cell 16. When all of the containers to be unloaded have been removed from the cell 16, the frame 24 can be transported by the spreader bar 26 to another cell 16 to repeat the removal process, or new containers can be loaded into the cell 16.

To load a container 12 into the cell 16 with the elevator 10 located at the mouth or hatch opening of the cell 16, the crane and spreader bar 26 pick up the container 12 from a remote location. At this time, all four rotators 54 are in the standby position. The container 12 is lowered toward the frame 24. The flares 34*a* on the cell guide extensions 34 guide the lower corners of the container 12 between the cell guide extensions 34 until each container sensor 80 senses that the lower corner casting 12*b* is aligned with the corner casting pin 72. The container sensor 80 sends a signal to extend the proximal corner casting pin 72 from the container disengaged position in the frame 24, locking the corner casting pin 72 into the lower corner castings 12*b* of the container 12. After all of the corner casting pins 72 have fully extended into the container engaged position in the lower corner castings 12*b,* the crane/spreader bar combination further lowers the container 12 until the weight of the container 12 is resting on the corner casting pins 72 as shown in FIG. 4. Alternatively, the corner casting pins 72 are extended while the container 12 is being moved to the frame 25 and the container 12 is simply lowered onto the extended corner casting pins 72. The spreader bar 26 is then released from the container 12 in the known manner.

The spreader bar 26 is removed from the cell area to pick up another container in a remote location for subsequent loading into the cell 16. The rotators 54 are then rotated from the standby position to the hoisting position with the magnetic roller 52 magnetically attaching itself to the cell guide extension 34. The winch motor 42 is energized, rotating the winch reel 44 to play out the winch cable 46. The first and second pulleys 60, 62 change the direction of the winch cable 46 so that, as the winch cable 46 is played out from the winch reel 44, the twist lock 50 is lowered down the cell guide extension 34. The twist lock 50 travels down the cell guide extension 34 until the shear key 64 encounters the top of the container 12.

The key 64 of the twist lock 50, enters the corner casting 12*a* in the top of the container 12 as shown in FIG. 8. The sensor 66 on the twist lock 50 detects that the key 64 has entered the corner casting 12*a* and preferably sends a signal through the winch cable 46 to the winch controller to stop the winch reel 44. Additionally, the sensor 66 sends a signal to the twist lock actuator system to rotate the shear key 64 to engage the shear key 64 with the container upper corner casting 12*a*. If the sensor 66 senses that the shear key 64 of the twist lock 50 is not properly located within the container upper corner casting 12*a,* the sensor 66 activates the jogging mechanism 70 to jog the twist lock 50 and nest the shear key 64 in the container upper corner casting 12*a* prior to sending the signal to the hydraulic system to engage the shear key 64 of the twist lock 50 in the upper corner casting 12*a*.

When the keys 64 of all four twist locks 50 are engaged with their respective upper corner castings 12*a,* each winch motor 42 is activated to reel in the winch cable 46 enough to release the weight of the container 12 from all of the corner casting pins 72. When the sensors 73 in each of the corner casting pins 72 sense that the weight of the container 12 has been removed from the corner casting pins 72, the corner casting pins 72 retract into the frame 24 to the container disengaged position. After all of the corner casting pins 72 have been fully retracted, each winch motor 42 is energized to rotate the winch reel 44 to play out the winch cable 46, lowering the container 12 into the cell 16. The cell guides 20 direct the container 12 as the container 12 is lowered into the cell 16. When the container 12 has been fully lowered (either to the bottom of the cell 16 or to the top of the uppermost container within the cell 16), the sensor 66 in the twist lock 50 will sense that the weight of the container 12 has been relieved from the twist lock 50, and will send a signal to the winch motor 42 to stop. The sensor 66 will then send a signal to the twist lock actuator to rotate and release the key 64 of the twist lock 50 from the upper corner casting 12*a*. Alternatively, the winch 40 can include a sensor (not shown) that senses a release of tension in the winch cable 46 and signals the twist lock 50 to release the key 64 from the upper corner casting 12*a*.

After the twist lock 50 is released from the upper corner casting 12*a,* the sensor 66 in the twist lock 50 will send a signal to the winch motor 42 to operate the winch reel 44 to lift the winch cable 46 and the twist lock 50 to the top 34*a* of the cell guide extension 34 as shown in FIG. 6. After the twist lock 50 returns to the top 34*a* of the cell guide extension 34, the rotator 54 rotates the twist lock 50 from the hoist position to the standby position as shown in FIG. 5, and the elevator 10 is ready to accept another container 12.

Although use of the modular cell elevator has been discussed previously with respect to transferring containers 12 to and from cells 16 by supporting the container from their lower casting 12*b* on the corner casting pins 72, 172, it will be appreciated that the elevator 10 can be configured to support containers from their upper corner castings 12*a* by engaging those castings with the corner casting pins 72, 172. The upper corner castings can be engaged by such pins as well as by the twist locks of the elevator or a spreader bar. This would permit the provision of a lower, more compact elevator.

Furthermore, although separate hoists 30 are shown at each corner, it will be appreciated that the hoist could be configured in a way to commonly drive a pair of reels by a single motor on one side of the frame and further that a pair of reels can be centrally mounted along one of the frame sides to rotate on a common axis or be driven by a common shaft.

While the frame 24 is shown with four (4) cell guide extensions 34 in the form of stand alone angle irons, it will be appreciated that appropriate bracing between those angle irons and the base of the frame can be provided as necessary or desired for strength and rigidity.

Figure 10:
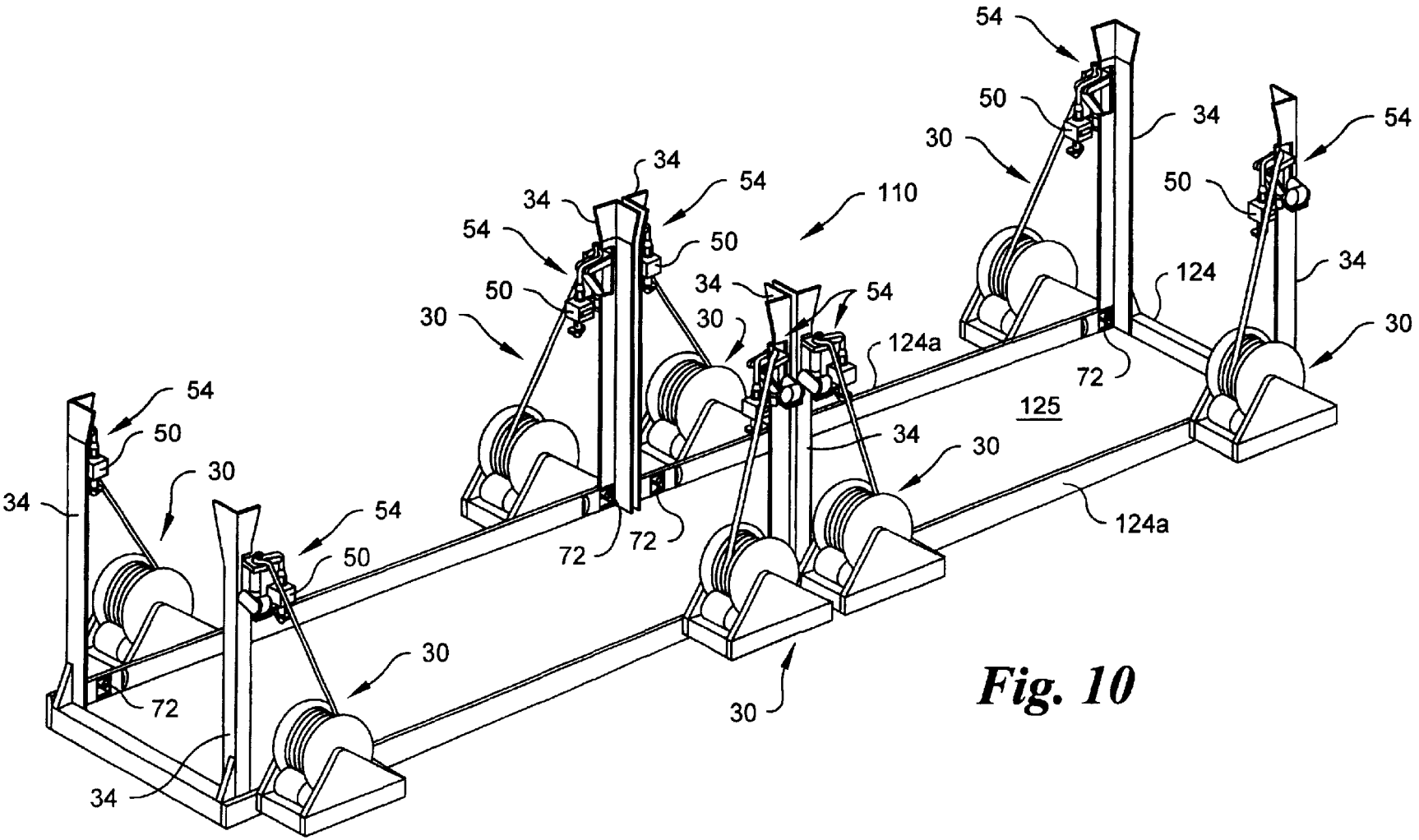
FIG. 10 is a perspective view of an alternate embodiment of an elevator.

Although the elevator 10 preferably only includes hoists 30 at each of the four corners of the frame 24, a modified version of an elevator 110, shown in FIG. 10, which is sized to handle forty or forty-five foot containers, includes additional hoists 30 and corresponding casting pins 72 located generally in the middle of each longitudinal side 124*a* of a frame 124. These additional features allow two unconnected twenty foot containers 112, 212 in a forty or forty-five foot long cell 116 (shown in FIG. 11) to be individually transported between the frame 124 and the cell 116 as described above with regard to the cell 16 and the frame 24. The containers 112, 212 can the be individually removed from the elevator 110 by one or more spreader bars 26.

As shown in FIG. 11, the modular cell elevator 10 can also be used to lift simultaneously the first and second adjacent twenty foot containers 112, 212 from a cell 216 using a frame, such as frame 24, sized to lift a single forty foot container. A connector 114 is used to connect an upper corner casting 112*a* of the first container 112 with an adjacent upper corner casting 212*a* of the second container 212. Two connectors 114 are required to properly connect the first container 112 to the second container 212, one on either lateral side of the containers 112, 212. However, for this description, only one connector 114 will be discussed.

The connector 114, shown in phantom in FIG. 11, is releasably connected to the twist lock 50, which is located proximate to the first container 112. Preferably, the connector 114 is connected to the twist lock 50 by an electromagnetic or other releasable means. Connector 114 can also be provided with a recess (not depicted) on its upper side to receive the key 64 of one of the twist locks 50 to be transported beneath the twist lock 50.

Figure 13:
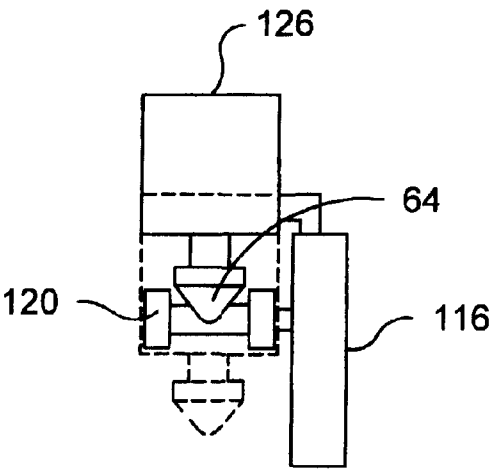
FIG. 13 is a side view of the connector for connecting the first container to the second container taken along line 13—13 in FIG. 12.
Figure 12:
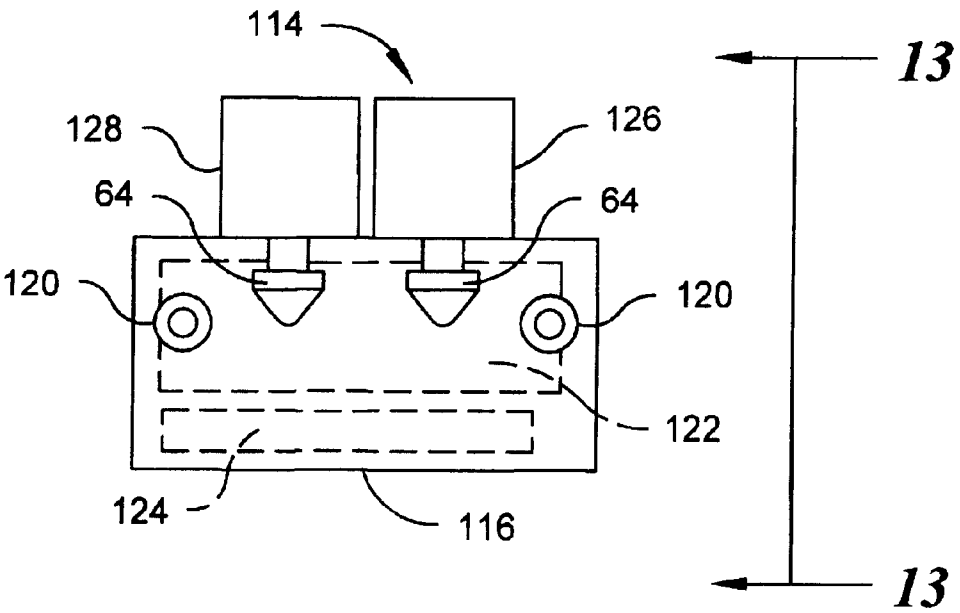
FIG. 12 is a front view of a connector for connecting a first container to a second container in accordance with a preferred embodiment of the present invention.

Referring to FIGS. 12–13, the connector 114 comprises a carriage 116 which is engageable with the top of the first container 112 to transport the connector 114 from a magnetic roller 52 to a junction between the first container 112 and the second container 212. Preferably, the carriage 116 is magnetically attached to the first container 112 so that the connector 114 does not fall off the first container 112 as it traverses the first container 112. The carriage 116 includes a set of two pairs of guide rollers 120, which engage the top of the first container 112 and transport the connector 114 from the twist lock 50 to the junction between the first container 112 and the second container 212. Preferably, the carriage 116 is configured so that a portion of the connector 114 is on the top of the container 112 and is supported by the guide rollers 120, while a remaining portion of the carriage 116 is positioned along side the container 112, as shown in FIG. 11. A motor 122, preferably a linear induction motor, shown in phantom in FIG. 12, is mounted in the carriage 116 and is operatively connected to the guide rollers 120 to provide propulsion power to the guide rollers 120. A sensor 124, shown in phantom in FIG. 12, is mounted in the carriage 116 for detecting when the guide rollers 120 are positioned on the top of the first container 112, for releasing the connector 114 from the twist lock 50, and for activating the motor 122 to power the guide rollers 120.

Mounted on the carriage 116 is a first coupler 126 in the form of a twist lock with a bayonet key 64 which is insertable into a first container upper corner casting 112*a*. The first coupler 126 is mounted on the carriage 116 for vertical displacement between an upper, transit position and a lower, locking position. Similarly, a second coupler 128 is provided in the form of a separate twist lock with a bayonet key 64, which is insertable into a second container upper corner casting 212*a* on the second container 212. The second coupler 128 is mounted on the carriage 116 for vertical displacement between an upper, transit position and a lower, locking position. Each coupler 126, 128 is rotatable between an unlocked position and a locked position in its respective container upper corner casting 112*a*, 212*a*.

Although the preferred connector 114 as described above is separate from the elevator 10 upon being released from the magnetic roller 52, those skilled in the art will realize that the connector 114 can include a tether connection (not shown) that connects the connector 114 to a remote control and/or power source (not shown) for operating and guiding the connector 114. Additionally, although the preferred connector 114 is described above, those skilled in the art will realize that the containers 112, 212 can be connected by other connectors (not shown), including manually installed connectors, for lifting as a single unit without departing from the spirit and scope of the present invention.

The operation of the connector 114 to connect two adjacent twenty foot containers 112, 212 will now be described. Since the operation of each of the connectors is identical, the operation of only the one connector 114 will be described. A connector 114 is releasably attached to a twist lock 50 on either lateral side 24*b* of the frame 24. The twist lock 50 is lowered to the top of the first container 112 within the cell 216 and is releasably connected to the container 112 as described above with respect to the container 12. As the twist lock 50 attached to the magnetic roller 52 engages with the top corner casting 112*a* of the first container 112, the connector 114 is placed on the top of the first container 112 so that the guide rollers 120 engage the top of the first container 112 proximate to the side of the first container 112, as shown by the connector 114 in phantom in FIG. 11.

After the twist lock 50 has engaged with the corner casting 112*a* of the first container 112 and the sensor 124 senses that the guide rollers 120 are positioned on top of the first container 112, the connector 114 releases from the magnetic roller 52 and the connector motor 122 is energized to transport the connector 114 from the magnetic roller 52 along the length of the first container 112 toward the second container 212, which is located within the cell 216 longitudinally adjacent to the first container 112 as shown in FIG. 11. In addition to providing propulsion force for the connector 114, the motor 122 produces an electromagnetic force to keep the connector 114 attached to the first container 112 to prevent the connector 114 from falling off the first container 112 as the connector 114 traverses the length of the first container 112. When the connector 114 reaches the end of the first container 112 proximate to the second container 214, the connector continues forward, traversing a gap between the first and second containers 112, 212 until the first and second couplers 126, 128 are located over the top corner castings 112*a* and 212*a* of the first and second containers 112, 212, respectively. The first and second couplers 126, 128 are extended downward from the connector 114 (shown in phantom in FIG. 13) to releasably engage each of the top corner castings 112*a*, 212*a* on each of the first container and the second container 112, 212. After the key of each of the first and second couplers 126, 128 is engaged in its respective top corner casting 112*a*, 212*a*, the coupler 126, 128 locks into its respective corner casting 112*a*, 212*a*. The containers 112, 212 are now locked together and can be lifted by the elevator 10 as a single unit.

Figure 14:
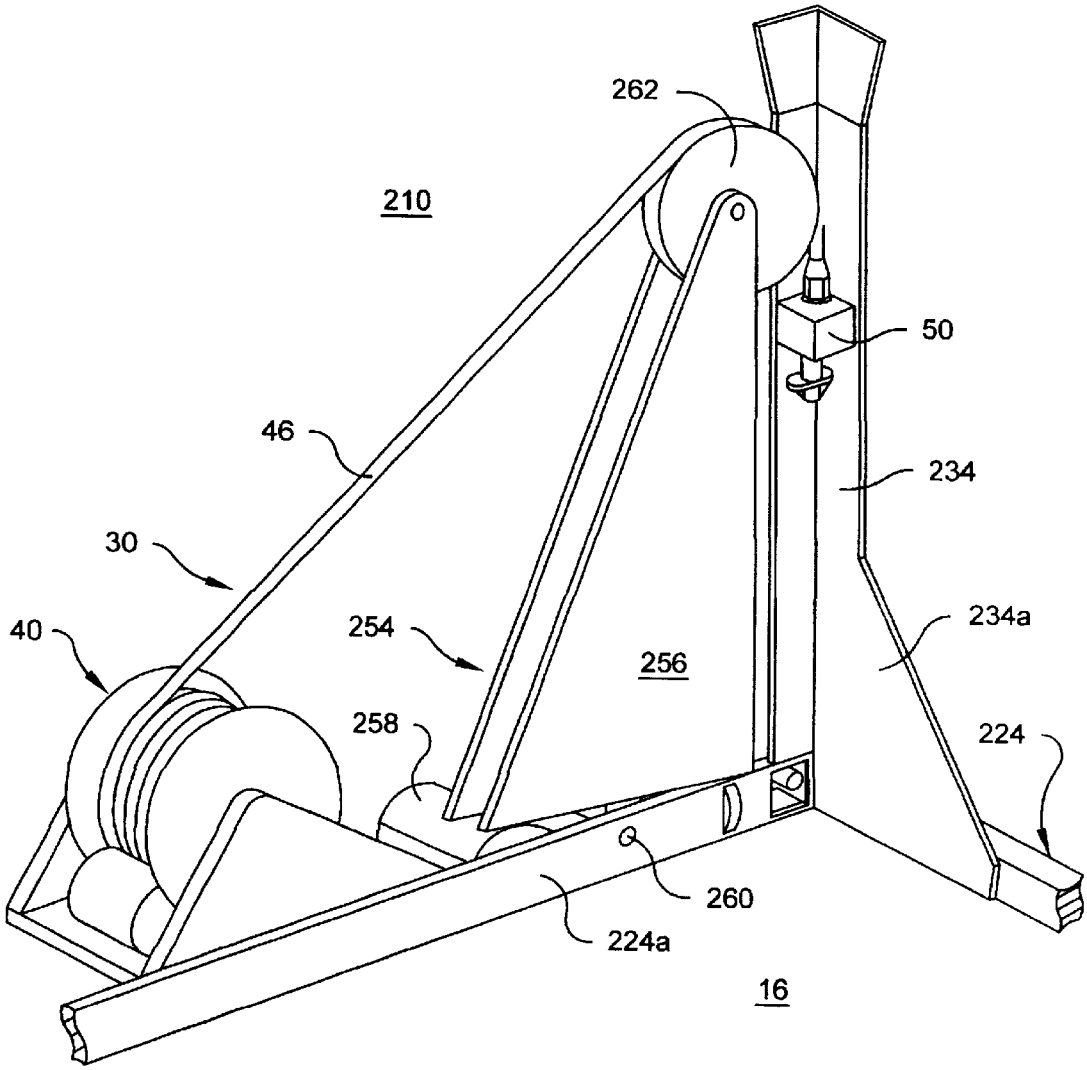
FIG. 14 is a perspective view of an elevator corner depicting an alternate hoist.

FIG. 14 depicts diagrammatically an alternate hoist structure, which utilizes a larger pulley 262 and fewer turns in the reel cable 46 to reduce the load imposed upon the cable. This elevator, indicated generally at 210, includes at least four hoists 30 of the type previously described, one located at each corner of the elevator 210. Alternatively, as was mentioned previously, pairs of reels can be located side by side or proximal to one another to be driven by the same motor or other prime mover. A rotator indicated generally at 254 includes a movable structure or frame indicated generally at 256, which provides support for the lifting process and allows a single, relatively large diameter pulley 262 to be moved into place for the lifting operation. The frame 256 is hinged at 260 to permit an upper end of the frame 256 to move the pulley 262 into and out from the cell guide extension 234. The hinge 260 is shown along the middle of the bottom wall of the frame 256 but could be located elsewhere. The front edge of the frame 256 proximal the cell guide extension 234 contacts the adjoining longitudinal side 224*a* of the frame 224 to stop rotation of the frame 256. Side 224*a* also provides structural support for the frame 256 when it is thus positioned. Rotator frame 256 is mounted to pivot at a diagonal with respect to longitudinal side 224*a* to permit the pulley 260 and twist lock 50 to be moved not only out of the cell guide 234 but out of the space above the cell 16, there by allowing clear access for a container to enter the cell. An actuator 258 needs only move the frame pulley assembly 256/262 when the twist lock 50 is not attached to a container and therefore does not have to move relatively much weight. The pivoting frame 256 can also be designed so that gravity would pivot the frame 256 and pulley 262 into the lifting configuration indicated in FIG. 14. The figure also indicates how an extension 234 may be strengthened by the addition of an additional web 234*a*.

Although it is preferred that a control system remotely and/or automatically controls the operations described above, those skilled in the art will realize that a human operator can remotely and/or manually perform the operations described above.

It will be appreciated by those skilled in the art that changes could be made to the embodiments described above without departing from the broad inventive concept thereof it is understood, therefore, that this invention is not limited to the particular embodiments disclosed, but it is intended to cover modification within the spirit and scope of the present invention as defined by the appended claims.

What is claimed is:

1. A modular cell elevator for transferring containers through a container cell mouth opening on a container ship, the modular cell elevator comprising:

a frame mountable on a container cell in an open hold of the ship, the frame having a central opening therethrough sufficiently large to pass a container fitting the cell vertically through the frame;

a plurality of hoists mounted on the frame and releasably engageable with at least one container so as to transfer a container in either vertical direction up and down through the central opening and between a first location proximal the mouth opening of the container cell and a second location below the first location and mouth opening of the container cell in the container cell; and a plurality of supports on the frame releasably engageable with the container in the first location proximal the cell mouth opening so as to support the container in the first location separately from the hoists.

2. The modular cell elevator according to claim 1, wherein the plurality of supports are movable on the frame between a container engaged position and a container disengaged position when a container is in the first location, and wherein the frame further comprises at least one sensor located to sense a container in the first location to engage with the supports.

3. The modular cell elevator according to claim 1, wherein the frame comprises a base with four corners around the central opening.

4. The modular cell elevator according to claim 3, wherein a separate one of the plurality of hoists is located at each of the four corners.

5. The modular cell elevator according to claim 3, wherein the central opening is larger on a top side of the frame than on a bottom side of the frame.

6. The modular cell elevator according to claim 1 further comprising:

each hoist of the plurality including a winch and a cable having a first end and a second end, the first end being attached to the winch;

a twist lock on the second end of the cable insertable into and being engageable with a corner fitting on the container;

an actuator on the twist lock to engage the twist lock with the corner fitting; and a sensor located on the twist lock so as to sense the insertion of the twist lock into the corner fitting.

7. The modular cell elevator according to claim 6, further comprising a jogging mechanism operatively connected to the sensor so as to jog the twist lock when the sensor senses the twist lock failing to nest in the corner fitting so as to nest the twist lock in the corner fitting.

8. The modular cell elevator according to claim 1 further comprising a device to connect a first container to a second, adjacent container in the cell, the device being releasably connected to one of the hoists, the device disconnecting from the hoist after engagement of the device with one of the first and second containers, the device including:

a carriage engageable with the one of the first and second containers to transport the device from the hoist to a junction between the first container and the second container;

a first coupler insertable into a first container corner fitting, the first coupler being rotatable between an unlocked position and a locked position in the first container corner fitting;

a second coupler insertable into a second container corner fitting, the second coupler being rotatable between an unlocked position and a locked position in the second container corner fitting;

an actuator operably connected to the first and second couplers to insert the first coupler into the first corner fitting and to lock the first coupler to the first corner fitting and to insert the second coupler into the second corner fitting and to lock the second coupler to the second corner fitting, respectively; and a sensor located to sense the first and second couplers being positioned to be insertable into the first and second corner fittings, respectively, the sensor providing a signal to the actuator to insert the first coupler into the first corner fitting and to lock the first coupler to the first corner fitting, and to insert the second coupler into the second corner fitting and to lock the second coupler to the second corner fitting.

9. The modular cell elevator according to claim 8, wherein the carriage of the device is magnetically attached to the one of the first and second containers.

10. A method of using the modular cell elevator of claim 8 for connecting a first container in the cell to a second, adjacent container in the cell, the method comprising the steps of:

releasably connecting at least one of the hoists to one of the first and second containers;

releasing the device from the hoist to connect a first shipping container to a second, adjacent shipping container;

transporting the device from the hoist to the other of the first and second containers such that the device extends over the first and second containers; and releasably connecting the device to the first container and the second container.

11. A method of using the modular cell elevator of claim 1 for transferring a container between a first location at a mouth of a container cell wherein a lower end of the container is engaged by the plurality of supports and a second location in the container cell of a container ship, the method comprising the steps of:

releasably mounting the frame on a container cell in an open hold;

releasably connecting at least one of the hoists mounted on the frame to a container;

transferring the container between the first location and the second location with the hoist;

moving the plurality of supports on the frame between a container engaged and a container disengaged position; and releasing the at least one hoist from the container.

12. The method according to claim 11, further including, after the releasably mounting step, the step of transferring the container between the plurality of supports and a spreader bar.

13. The method according to claim 11, wherein the moving step occurs before the transferring step.

14. The modular cell elevator according to claim 1, wherein the plurality of supports are mounted to the frame for movement on the frame between a container engaged position and a container disengaged position.

15. The modular cell elevator according to claim 14 further comprising at least one sensor located on the frame to sense a container in the first location.

16. The modular cell elevator according to claim 15 wherein the sensor is operably coupled with at least one of the supports to control automatic movement of the at least one support between the container disengaged and container engaged positions.

* * * * *